US005906214A

United States Patent [19]

Gueret

[11] Patent Number: 5,906,214

[45] Date of Patent: May 25, 1999

[54] PACKAGING UNIT PERMITTING THE STORAGE AND THE APPLICATION OF A LIQUID OR PASTY PRODUCT TO A BASE

[75] Inventor: Jean-Louis H. Gueret, Paris, France

[73] Assignee: L'Oreal, Paris, France

[21] Appl. No.: 08/805,250

[22] Filed: Feb. 24, 1997

[30] Foreign Application Priority Data

Feb. 23, 1996 [FR] France ..... 96-02269

[51] Int. Cl.[6] ..... A45D 40/24

[52] U.S. Cl. ..... 132/314; 132/316; 132/317

[58] Field of Search ..... 132/218, 313, 132/314, 315, 316, 317, 294; 401/118, 126, 127, 129, 130; 215/242, 239, 240, 241

[56] References Cited

U.S. PATENT DOCUMENTS

| | | | |
|---|---|---|---|
| 2,143,061 | 1/1939 | Eastley | 132/318 |
| 2,426,288 | 8/1947 | Wagner | 132/317 |
| 2,504,677 | 4/1950 | Fraser et al. | 132/313 |
| 2,666,222 | 1/1954 | Gordon | 132/218 |
| 3,613,697 | 10/1971 | Andrews | 132/317 |
| 4,165,755 | 8/1979 | Cassai | 132/218 |
| 4,600,328 | 7/1986 | Clements | 132/218 |
| 4,617,948 | 10/1986 | Gueret | 132/218 |
| 4,886,080 | 12/1989 | Cole | 132/317 |
| 4,893,724 | 1/1990 | Schiemann . | |
| 4,949,858 | 8/1990 | Sheridan | 215/239 |
| 5,163,457 | 11/1992 | Lombardi, Jr. | 132/316 |
| 5,391,011 | 2/1995 | Gueret | 132/218 |

FOREIGN PATENT DOCUMENTS

| | | |
|---|---|---|
| 2 590 456 | 5/1987 | France . |
| 2 701 196 | 8/1994 | France . |

*Primary Examiner*—Todd E. Manahan

*Attorney, Agent, or Firm*—Oblon, Spivak, McClelland, Maier & Neustadt, P.C.

[57] ABSTRACT

A packaging unit which permits the storage and application of a liquid or pasty product to a base includes at least one reservoir containing the product to be applied and an applicator associated with the reservoir. The applicator includes, on the one end, an application element and, on the other end, a gripping member. The application element of an applicator is capable of being accommodated in an associated reservoir and is detachable from the reservoir. A sealing member is provided between the reservoir and its associated applicator to allow the reservoir to be obturated by the associated applicator for an appropriate positioning of the gripping member relative to the reservoir. The reservoir is contained in a shell which provides free access to the opening of the reservoir, the obturation of the reservoir is obtained when the corresponding application element is accommodated in the reservoir by compressing the sealing member of the reservoir by the positioning of the gripping member of the application element along the shell.

31 Claims, 6 Drawing Sheets

PACKAGING UNIT PERMITTING THE STORAGE AND THE APPLICATION OF A LIQUID OR PASTY PRODUCT TO A BASE

BACKGROUND OF THE INVENTION

1. Field of the Invention

The present invention concerns a packaging unit permitting the storage and application of a liquid or pasty product to a base, in particular the application of makeup, or of a hair product to the skin, to the keratinous fibers or to the nails of a user. Such a packaging unit can be used, for example, for applying a reinforcing agent also called mascara to the eyelashes, or for applying an eyeliner, an eye shadow, a nail varnish or the like.

2. Discussion of the Background

A packaging unit for makeup, or for a hair product, generally comprises a reservoir containing the product to be applied and also a detachable applicator which is intended to close the reservoir. The applicator comprises a gripping means which allows the user to manipulate it and also an application element, for example, a stem, at the free end whereof there is fixed a brush, a pencil brush or the like.

In the position where the applicator closes the reservoir, the application element dips into the reservoir; when the applicator is separated from its associated reservoir, the pencil brush or the like, takes up a certain quantity of the product which can then be applied to the base for which it is intended.

Since such a packaging unit is generally placed in a handbag or a makeup pouch, it must be of as small a size as possible. Moreover, it must be convenient to use, both from the point of view of its being opened, and during application of the make-up product.

To satisfy the requirements mentioned above, a packaging unit of this type has already been proposed in FR-A-2 701 196, comprising a reservoir containing the product to be applied and a detachable applicator intended to close the reservoir, the applicator having a closing bearing surface intended to cooperate with a seat arranged opposite the opening of the reservoir. In this packaging unit a handle, allowing the applicator to be gripped, is articulated around a pin carried by the application element, this handle being constituted by a shackle whose dimensions are such that, in the completely folded-back position of the handle, the shackle surrounds the reservoir and cooperates with the bottom of the reservoir to ensure sealing of the closure of the reservoir by the applicator. In this device, the reduction in bulk is substantial since, in the storage position, the handle of the applicator is folded back around the reservoir instead of projecting relative to the reservoir and being generally in the extension of the latter.

In French Patent Application FR-A-2738126, there has also been proposed a portable packaging unit for mascara, comprising a reservoir and an applicator provided with a flat handle and a bristle portion mounted on this handle, the applicator being capable of closing the reservoir. In this embodiment, the length of the reservoir is substantially equal to that of the bristle portion, the portion being fixed directly to the handle, entailing a limitation of the bulk of the packaging unit.

However, in this prior art, the reservoirs of these packaging units always have a shape appropriate for cooperation with the applicator and it is not possible to use reservoirs of a conventional shape, that is to say, a cylindrical shape, in particular for constituting refills. This results in a relatively high price, and it would be desirable if one could reduce it.

SUMMARY OF THE INVENTION

The object of the present invention is to propose a packaging unit of the type indicated above, which makes it possible, on the one hand, to use reservoirs of any shape whatever, and in particular a cylindrical shape, and which is, on the other hand, of a limited size because in the closed position of the reservoir the gripping means of the applicator is in a retracted position and does not project with its whole length in the axis of the reservoir.

Thus the present invention provides a packaging unit permitting the storage and application of a liquid or pasty product to a base, the packaging unit comprising at least one reservoir containing the product to be applied; and an applicator associated with the/each reservoir, the applicator comprising, on the one hand, an application element and, on the other hand, a gripping means interconnected by a pivot pin, the application element of an applicator being capable of being accommodated in its associated reservoir into which it can penetrate through an opening of the said reservoir, and being detachable from the reservoir, a sealing means being provided between the/each reservoir and its associated applicator to allow the obturation of the/each reservoir by the associated applicator, the implementation of this obturation being obtained thanks to an appropriate positioning of the gripping means relative to the reservoir. According to the invention, the reservoir(s) is/are contained in a shell which arranges free access to the opening of the/each reservoir, the obturation of the/each reservoir being obtained when the corresponding application element is accommodated in its associated reservoir by compressing the sealing means of the reservoir in question by the positioning of the gripping means of the application element along the shell.

It is obvious that the packaging unit in accordance with the invention makes it possible to use quality materials for the shell, thus promoting the pleasing appearance of the packaging unit, while retaining for the reservoir(s) a material which has the technical properties required for storage and good preservation. The shell may be formed by a wall with a small thickness.

In a preferred embodiment, the shell comprises at least one stop cooperating with the gripping means to ensure compression of the sealing means. The shell may also have at least one retaining means cooperating with the gripping means to ensure the compression of the sealing means.

The gripping means of an applicator is articulated for pivoting relative to the application element of the applicator. In this manner, if the packaging unit has a stop/retaining means pair for each gripping means, when the gripping means is disengaged from the retaining means associated therewith, it no longer cooperates with the stop that is associated with it, which permits the extraction or introduction of the application element in the corresponding reservoir. When the retaining means is positional, by pivoting relative to its application element, so as to be held in position by the retaining means, it bears against its associated stop, so that the application element should elastically compress its associated sealing means. The gripping means may be telescopic.

In a first embodiment, the packaging unit in accordance with the invention has a single reservoir and a single applicator. In another embodiment, it has two reservoirs, each associated with an applicator, and in this case, the two reservoirs can be disposed head to tail within the shell.

The shell may advantageously be constituted by two half-shells joined to one another. The two half-shells can be connected to one another by a film hinge and/or be joined by catch engagement, which allows the shell to be capable of being opened by the user and be subsequently closed again. Provision may then be made inside such a shell for at least one reserve container interchangeable with a reservoir, so that the user can place the reserve container, instead of the reservoir, into position after the shell has been opened.

The reservoir(s) may also be disposed in a recess of the shell, whence it/they can be extracted via the small side of the shell along which the gripping means of the corresponding applicator comes to bear, or via the opposite side.

When the shell contains several containers of the product (s), it is preferable that inside the shell the axis of one reservoir should be parallel to the axis of the other reservoir and/or of the reserve container(s). When two reservoirs are disposed head-to-tail in the shell and when they are obturated by their associated applicators, the gripping means of the two applicators may be disposed head-to-tail on two opposite sides of the shell. When two reservoirs are disposed parallel and in the same direction on either side of a median plane inside the shell, the gripping means are advantageously disposed symmetrically with reference to said median plane. Preferably, when a reservoir is obturated by its associated applicator, the gripping means of the applicator bears against the shell.

In an advantageous embodiment, the shell defines a space in the form of a rectangular parallelepiped and comprises two large side faces, a gripping means coming to bear against a small side of the parallelepiped shell when the reservoir associated therewith is obturated, and the axis/axes of the reservoir(s) being perpendicular to one of the small sides of said shell against which there bears a gripping means. In another embodiment, the shell defines a space in the form of an upright prism comprising two large parallel, substantially triangular sides, a gripping means coming to bear against one of the sides of the shell when the reservoir which is associated therewith is obturated. The shell may carry a mirror on at least one of its large sides.

In a preferred embodiment, the (or at least one of the) reservoir(s) is associated with a wiper capable of wiping the application element of the applicator associated with the reservoir(s). However, as a variant, provision may also be made for the (or at least one of the) reservoir(s) to be associated with a glove finger having at least one capillary opening capable of dosing the product on the application element.

When the gripping means of an applicator is articulated for pivoting relative to the application element of the applicator, it is preferable for the axis of pivoting to be perpendicular to the large sides of the shell when the applicator is in the position of obturating the reservoir with which it is associated. The axis of pivoting of the gripping means is preferably nearer a zone of the first end of the gripping means than the zone of the second end of this same gripping means, the zone of the first end coming to cooperate with a stop of the shell, while the zone of the second end cooperates with a retaining means of the shell. The zone of the first end of the gripping means can come to bear against a stop of the shell when the gripping means is brought to bear against the shell, so as to exert a force on the applicator in the direction towards the reservoir which is associated therewith. The stop may be T-shaped and the zone of the first end of the gripping means may comprise two studs each coming to bear against one arm of the T. However, the stop may also have the form of a shackle, and the zone of the first end of the gripping means then comprises a stud capable of coming to bear against the web of the shackle. In a first variant, the retaining means may be an elastic clip projecting relative to the side of the shell along which the gripping means comes to bear in the course of the obturation of the corresponding reservoir. In another variant, the retaining means may be a catch engagement means disposed in the vicinity of the side of the shell along which the gripping means comes to bear in the course of the obturation of its associated reservoir.

When the gripping means of an applicator is articulated for pivoting relative to the application element of the applicator, the pivot pin is advantageously carried by a component of the application element, the component and/or the gripping means carrying restraining means to prevent the free pivoting of the gripping means relative to the application element.

The application element may be constituted by a stem, at the end of which there is disposed an applicator component. The applicator component may be a rough surface obtained by being molded together with the stem, or a brush, a pencil brush, an elastomeric quill, a flocked surface, or the like.

The shell may comprise at least one projection capable of cooperating with the zone of the first end of a gripping means when the gripping means is pivoting to eliminate the obturation of its associated reservoir, so as to lift the applicator relative to the reservoir. Moreover, the shell may be perforated and may, in particular, allow the reservoir(s) to be seen, which in the course of use allows the user to identify the level of fill of the reservoir (or reservoirs) or the color of the make-up which it (or they) contain(s) in the case of a transparent or translucent reservoir (or reservoirs).

The packaging unit in accordance with the invention is particularly useful when the product to be applied is a cosmetic, a hair product or a makeup product, and when the base of application is the skin, the keratinous fibers or the nails.

BRIEF DESCRIPTION OF THE DRAWINGS

To render the invention more readily understood, five embodiments, represented in the attached drawings, will now be described by way of purely illustrative and non-restrictive examples. In these drawings.

DESCRIPTION OF THE PREFERRED EMBODIMENTS

Figure 1:
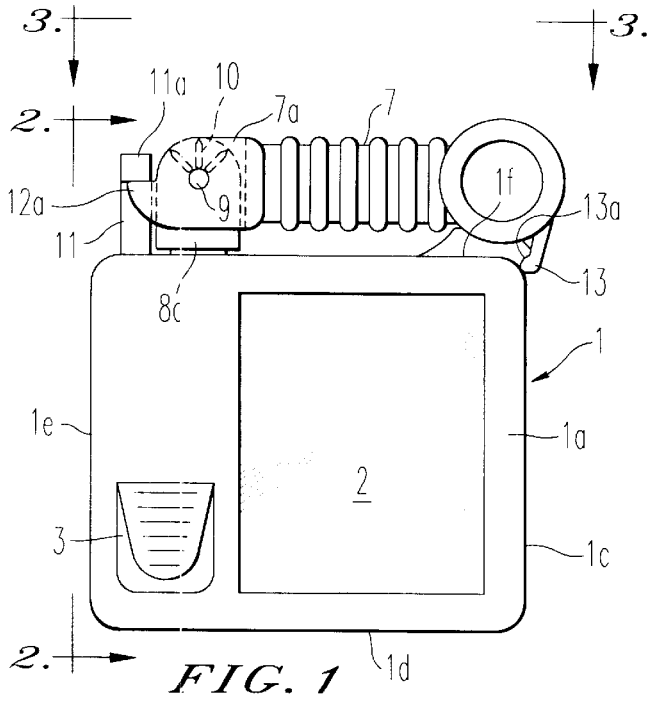
FIG. 1 shows in elevation a first embodiment of packaging unit of the invention.
Figure 2:
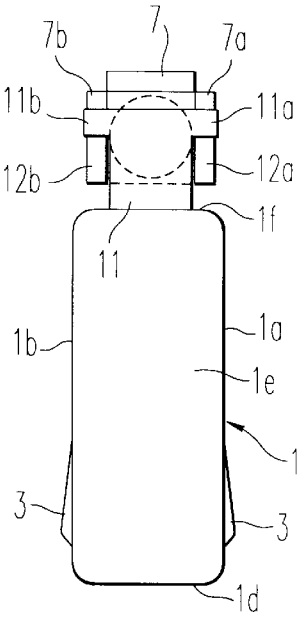
FIG. 2 shows a view taken along line 2—2 of FIG. 1.
Figure 3:
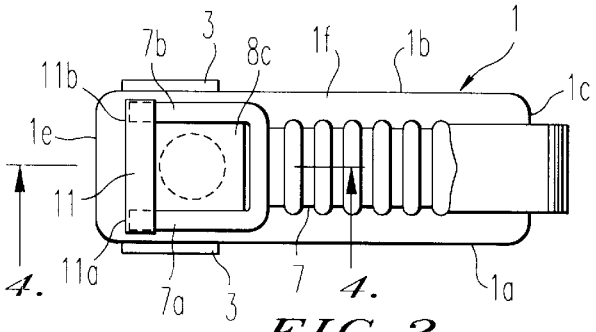
FIG. 3 shows a view taken along line 3—3 of FIG. 1.
Figure 4:
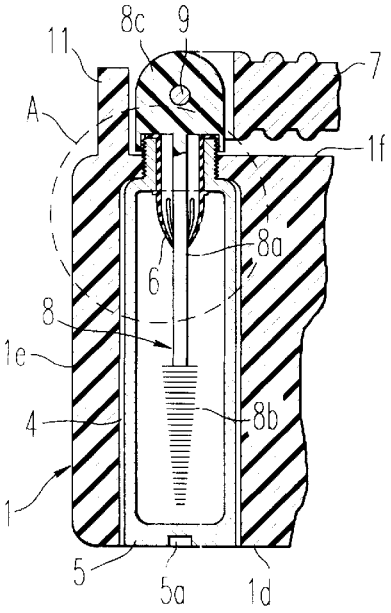
FIG. 4 shows a partial section on line 4—4 of FIG. 3.
Figure 5:
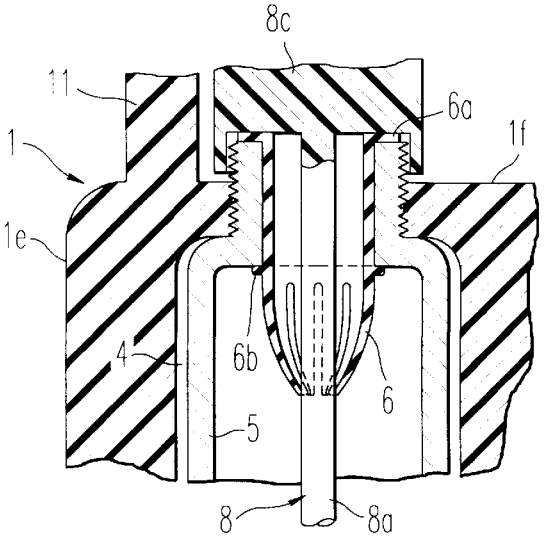
FIG. 5 shows a view of zone A of FIG. 4 on an enlarged scale.
Figure 6:
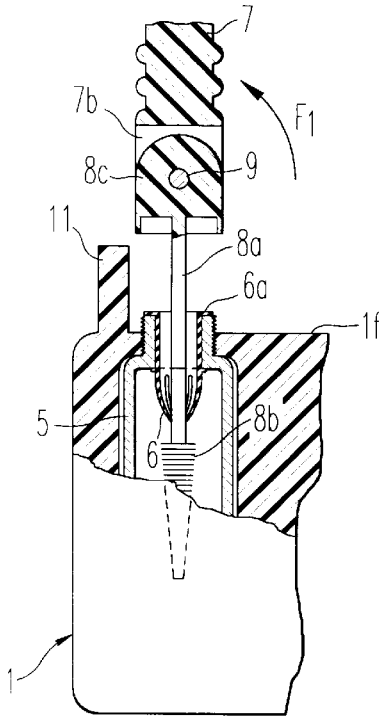
FIG. 6 shows a detail of the section of FIG. 4 when the applicator is in the course of being extracted from its associated reservoir.

Referring to FIGS. 1 to 6, it will be see that the shell of the packaging unit in accordance with the invention has been designated by reference number 1 as a whole. The shell 1 has the shape of a rectangular parallelepiped whose edges are rounded off. It is made of a plastic material and is delimited by two large sides 1*a*, 1*b*, and four small sides 1*c*, 1*d*, 1*e*, 1*f*. A mirror 2 has been positioned on side 1*a*. On the two large sides 1*a* and 1*b*, gripping zones 3 have been provided which form a slight relief and allow the packaging unit to be properly gripped by hand by the user.

In the shell 1, there is arranged a cylindrical recess 4 which opens out in the direction of side 1*d*. The recess 4 also opens out in the direction of side if via a threaded bore with a diameter smaller than the diameter of the recess 4. In the recess 4 there is positioned a cylindrical reservoir 5 which has a threaded neck whose thread cooperates with that of the bore through which the recess 4 opens out in the side 1*f*. On its bottom, on the opposite side to the threaded neck, the reservoir 5 has a groove or impression 5*a* allowing it to be screwed into the threaded bore of the recess 4. In its neck, the reservoir 5 has a wiper 6, an end flange 6*a* which comes to bear on the end edge of the neck of the reservoir 5, holding of the wiper in position in the neck being ensured by means of a bead 6*b* which cooperates with the shoulder separating the neck from the reservoir 5 proper. The wiper 6 is formed in a known manner from a flexible and elastic material.

An applicator is intended to cooperate with the reservoir 5. This applicator is constituted by a gripping means 7 and an application element 8, one being articulated for pivoting relative to the other by means of a pivot pin 9. The pin 9 is carried by an element 8*c* of the application element, the element 8*c* being integral with a stem 8*a*, at the end of which there is disposed an applicator component 8*b* which, in the embodiment shown, is a brush. The application element 8 is thus constituted by elements 8*a*, 8*b*, 8*c*, element 8*c* being capable of coming to bear against the flange 6*a* of the wiper 6 to obtain a leakproof closure of the reservoir 5 by compression of the flange 6*a* when the stem 8*a* and the applicator component 8*b* are situated inside the reservoir 5 after having passed through the wiper 6. The two sides 7*a*, 7*b* of a stirrup are disposed on either side of the element 8*c*, which stirrup constitutes the first end zone of the gripping means 7. Between the element 8*c* and the sides 7*a*, 7*b* there are interposed restraining means, which are schematically outlined and represented by reference number 10 in FIG. 1, such that the pivoting between the gripping means 7 and the application element 8 is effected with friction, thus making it possible to maintain the angle of inclination chosen by the user between the gripping means 7 and the application element 8.

The shell 1 has, on its side 1*f* between the threaded bore intended for the reservoir 5 and the side 1*e*, a stop 11 that projects above the side 1*f* and which is constituted by a T, the stop being connected to the side 1*f* by the stem of the T, and the arms 11*a*, 11*b* of the T being perpendicular to the large sides 1*a* and 1*b* of the shell 1. The ends of the sides 7*a*, 7*b* of the gripping means 7 have studs 12*a*, 12*b* respectively. The gripping means 7 has the general shape of a cylindrical stem whose axis is capable of pivoting between a position where it is parallel to the side 1*f* and a position where it is perpendicular to this side. When the gripping means has its axis parallel to the side 1*f*, it is situated substantially in bearing contact against the side 1*f* of the shell, and the studs 12*a*, 12*b* come to bear respectively against the arms 11*a*, 11*b* of the stop 11. Holding of this position is ensured by a retaining means constituted by the catch engagement of a catch engagement bead 13 integral with the second end of the gripping means 7 (that is to say, that end which is further from the pivot pin 9) in a catch engagement groove 13*a* arranged in the shell 1. When the gripping means 7 is in its engaged position, the bearing of the studs 12*a*, 12*b* against the stop 11 generates a force on the element 7*c* which is directed towards the shell. This force is thus exerted on the application element 8 and entails compression of the seal which is constituted by the flange 6*a*. The result is that the catch engagement means 13, 13*a* produces a leakproof obturation of the reservoir 5.

When the user wishes to use the product to be applied contained in the reservoir 5, for example a mascara, she takes the shell into her hand by using the gripping zones 3 and she proceeds with the disengaging of the bead 13, which releases the gripping means 7 and allows it to be pivoted along arrow F1 to bring its axis to be perpendicular to the side 1*f*. The user then extracts the stem 8*a* out of the reservoir 5, the applicator component 8*b* being wiped by the wiper 6 in the course of this movement. Before the complete extraction, the user is able to establish the angle between the application element 8 and the gripping means 7 at which she wishes to effect an easy make-up, this angle being maintained thanks to the restraining means 10. A publication of makeup can be easily performed by using the mirror 2.

When the user has completed her makeup, she reintroduces the application element 8 into the reservoir 5 until the element 8*c* is caused to bear against the neck of the reservoir. At this moment she causes the gripping means 7 to pivot until the catch engagement of the bead 13 in the groove 13*a*, resulting in compression of the flange 6*a* and a leakproof obturation of the reservoir 5.

It will be seen that this embodiment simultaneously permits the use of a cylindrical reservoir of the conventional type and the creation of a packaging unit having a small size, because of the pivoting of the gripping means relative to its associated reservoir. Moreover, the use of a shell carrying a mirror 2, as well as the possibility of setting an angle between the gripping means 7 and the application element 8, greatly improve the ease and the accuracy of the application of the makeup. It should, moreover, be observed that the opening of such a packaging unit is quickly effected by the simple disengagement of the bead 13, which is another advantage as far as the user is concerned.

The leakproof obturation of the reservoir 5 is totally reliable because of the lever effect, due to the fact that the first end of the gripping means 7 (that is to say that end which carries the studs 12*a*, 12*b*) is much closer to the pin 9 than the second end (that is to say, that end which carries the catch engagement bead 13). If the retaining means exerts a retaining force f on the gripping means, the force exerted for the compression of the leakproof seal is f multiplied by the ratio of the lever arms, that is to say, the ratio of the total length of the gripping means 7 to the distance between the stop 11 and the pin 9. It is, moreover, possible to shape the gripping means in a pleasing and attractive manner for holding in the hand without in any way reducing the leakproof obturation of the reservoir.

Finally, for the manufacture of the reservoir because of the requirements of leakproof seals, it is possible to use aesthetic materials of higher quality than those which are used at present. Thanks to the presence of the cover shell, it is possible to an unlimited extent to make the packaging unit aesthetically less commonplace in spite of the use of a reservoir 5 and of an applicator component 8*b* which are entirely standard components.

Figure 7:
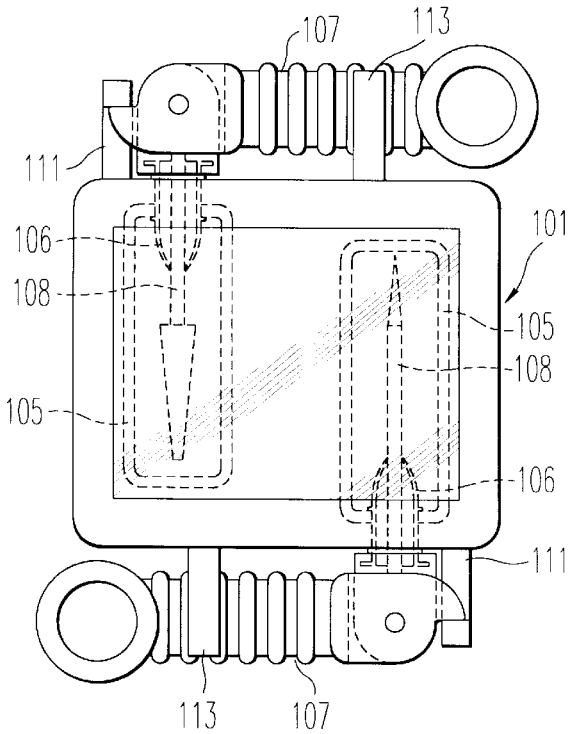
FIG. 7 shows, in elevation, a second embodiment of packaging unit according to the invention.

A second embodiment of the package in accordance with the invention has been shown in FIG. 7. In this embodiment, the reference numerals assigned to the elements similar to those of the first embodiment are those of FIGS. 1 to 6 but which appear in a 100 series.

The parallelepiped shell 101 has two bores disposed head-to-tail, in each one of which bores there is disposed a reservoir 105. Each reservoir 105 is provided with a wiper 106, an end flange of which comes to bear on the end of the neck of the reservoir 105. One applicator 107, 108, identical with the applicator of the first embodiment, is associated with each reservoir 105. The applicator component of one of the applicators is a brush, as in the case of the first embodiment, while the applicator component of the other applicator is, for example, an elastomeric quill. The reservoir associated with the brush contains, for example, a mascara, while the other contains, for example, an eyeliner.

The two gripping means 107 are identical and, when they are in the position of obturating the reservoirs 105, they are disposed head-to-tail on either side of the shell 1. The shell 101 has a T-shaped stop 111 for cooperating with each of the gripping means 107. The retaining means associated with each of the gripping means 107 is an elastic clip 113 whose two sides come to tightly grip the gripping means 107 between them, so as to hold it in the position where it substantially bears against the shell 101, that is to say in its position where its axis is parallel to the small adjacent sides of the shell 101, this position being that which corresponds to the leakproof obturation of the reservoirs 105.

The positioning of the reservoirs 105 in their recess is effected by insertion through the opening along which the recess opens out in the side opposite which the gripping means 107, associated with the reservoir 105 in question, will subsequently be positioned. The reservoir 105 is held in position by means of a threaded ring which comes to be screwed round the neck of the reservoir 105 in a thread cut in the vicinity of the opening issuing from the recess.

It will be found that in this embodiment it is possible to use two different products to be applied, which constitutes a substantial advantage as compared with the conventional packaging unit, without the overall bulk being appreciably increased, since the only surplus bulk as compared with the first embodiment corresponds to the positioning, at the edge of the shell, of a second gripping means intended for the second reservoir 105.

Figure 8:
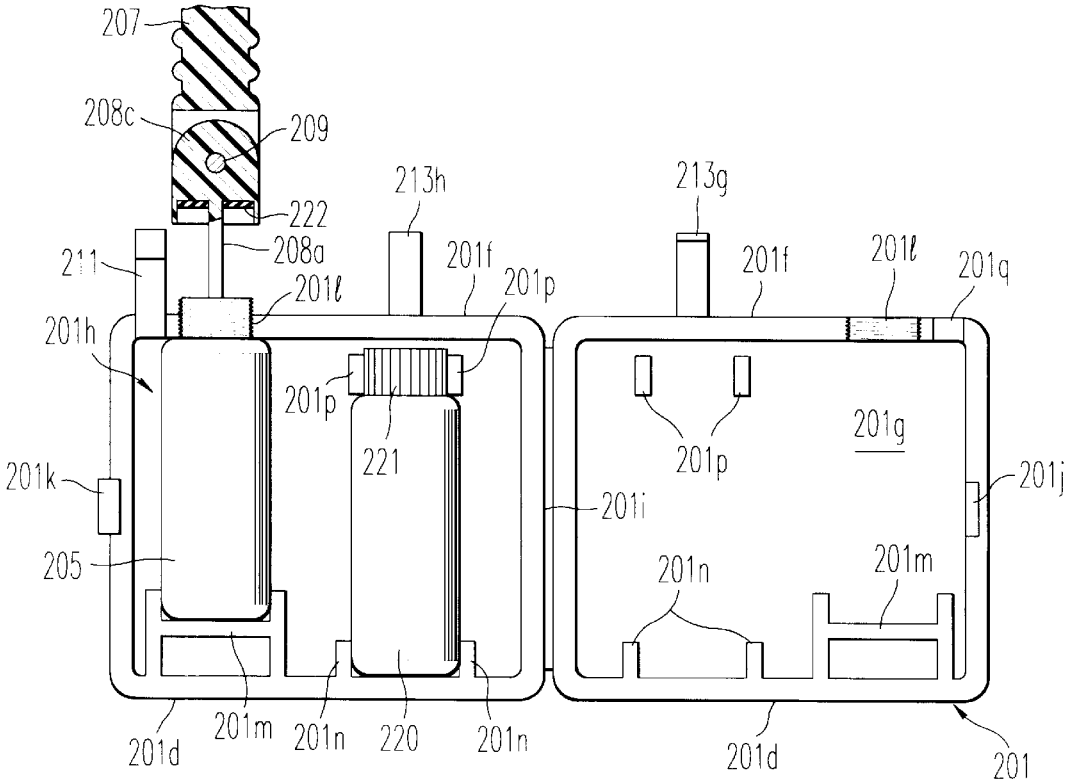
FIG. 8 shows in elevation the open position of the shell of a third embodiment of the packaging unit in accordance with the invention, the gripping means being shown in a sectional representation.
Figure 9:
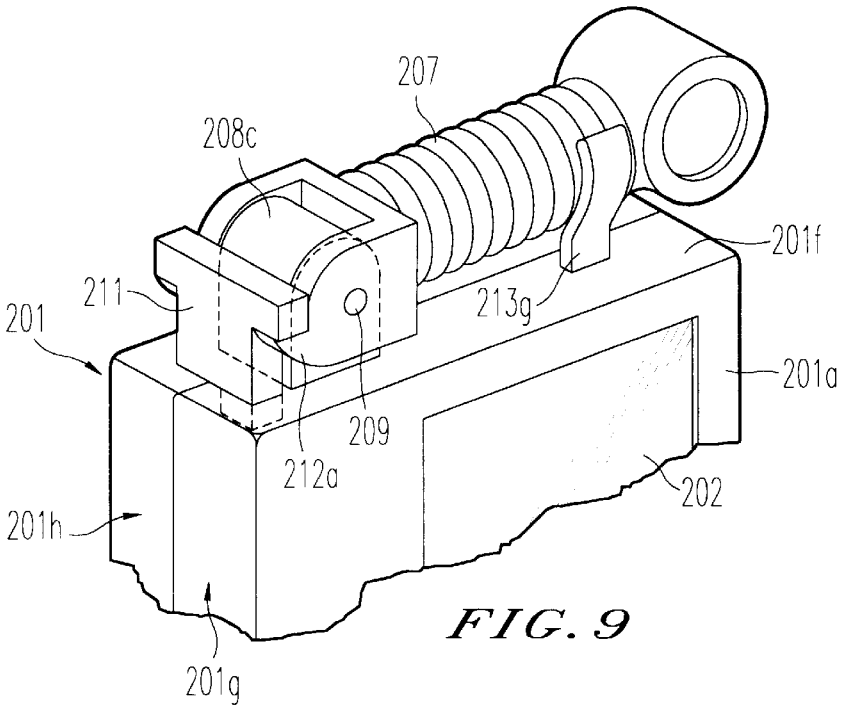
FIG. 9 partly shows the packaging unit of FIG. 8 in perspective when the shell is closed and when the gripping means bears against the shell.
Figure 10:
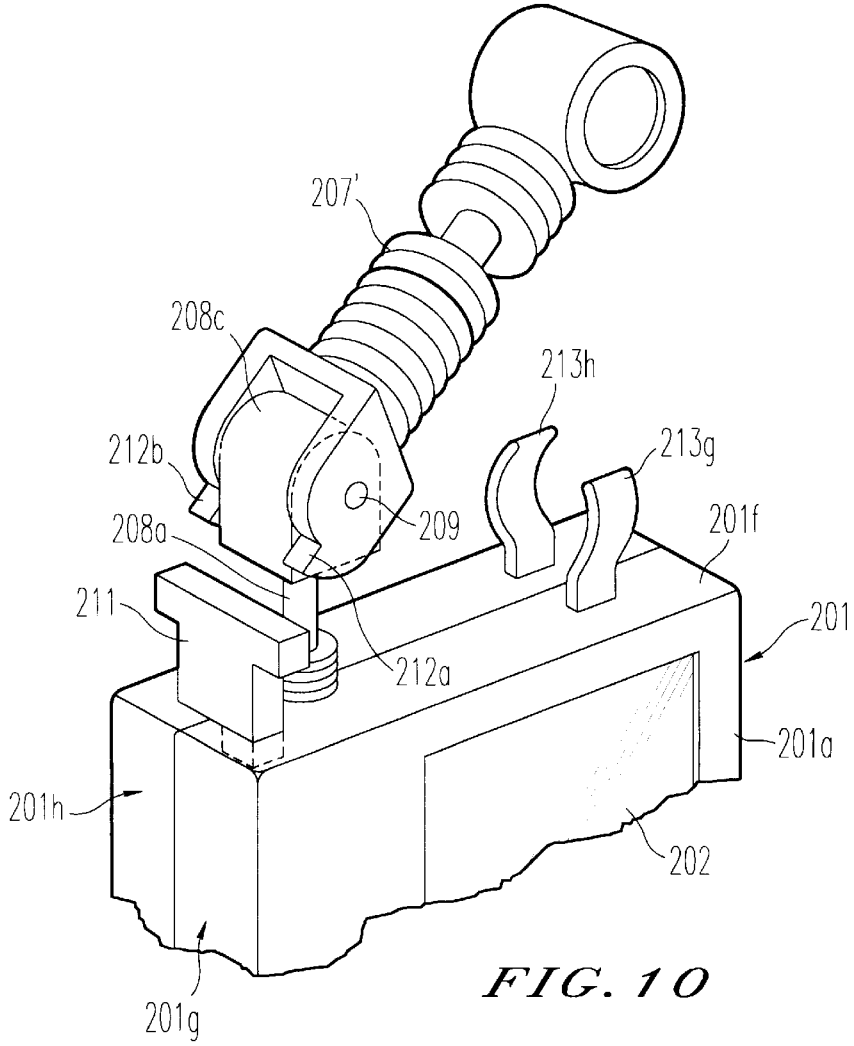
FIG. 10 shows a view similar to FIG. 9 when the applicator is in the course of being extracted.

A third embodiment of the package in accordance with the invention has been shown in FIGS. 8 to 10. In this embodiment, the reference numerals assigned to the elements similar to those of the first embodiment are those of the first embodiment but which appear in a 200 series.

The shell 1 is here constituted by two half-shells 201*g*, 201*h* which are connected to one another by a film hinge 201*i*, the closure of the two half-shells for constituting the shell 201 being maintained by a catch engagement means 201*h*, 201*k*. The half-shells 201*h* and 201*g* are symmetrical with one another relative to a plane, save for this difference that the half-shell 201*h* carries a T-shaped stop 211 which projects relative to the edge of the half-shell 201*h* and comes to be fitted in the side wall of the half-shell 201*g* when the two half-shells are closed one against the other. Each half-shell has a respective tab 213*h*, 213*g*, the set of these two tabs constituting a retaining means identical with the retaining means 113 of the embodiment of FIG. 7.

The depth of each half-shell corresponds to half the diameter of a cylindrical reservoir 205 which contains a makeup product, for example a mascara. The container 205 is placed into one of the half-shells, for example 201*h*. Its neck comes to be placed into a semicircular opening 201*l* of the small side face 201*f* of the shell (1). Of course, the shell 201*g* also has a semicircular cutout 201*l* so that, when the shell 201 is closed, the two semicircular cutouts 201*l* tightly grip the neck of the container 205. The container 205 has its bottom bearing on a seating block 201*m*, the same seating block being disposed inside the half-shell 201*g*. The height of the reservoir 205 between its bottom and the base of its neck is equal to the distance between the seating block 201*m* and the edge of the half-shells 201*g* and 201*h*.

Moreover, a reserve container 201 has been disposed inside the shell (1) which is identical with the reservoir 205, save for the difference in that a stopper 221 is screwed onto the threaded neck which it comprises, the neck being identical with the neck of the reservoir 205. This reserve container 220 is placed into position between the positioning studs 201*n* which project over those of the lateral edges of the half-shells 201*g*, 201*h* which are intended to form the side face 201*d* of the shell 201. Another pair of studs 201*p*, also integral with each of the half-shells 201*g*, 201*h*, comes to be positioned on either side of the stopper 221 so that, when the two half-shells 201*g*, 201*h* are closed one on the other, the reserve container 220 is laterally secured by the studs 201*n* and 201*p*; the fixing, in the direction of the axis of the reserve container 220, being effected in that the bottom of the reserve container bears on the side corresponding to the face 201*d* of the shell 201 and that the studs 201*p* are disposed at the level of the shoulder that connects the neck to the cylindrical portion of the reserve container.

The stop 211 is T-shaped, like the stops 11 and 111, but it laterally projects beyond the edge of the half-shell 201*h* and, when the shell 201 is closed by bringing the half-shells 201*g*, 201*h* to each other, this projecting portion of the stop 211 comes into a recess 201*q* arranged in the side wall of the half-shell 201*g*.

The applicator which is associated with the reservoir 205 is identical with the applicators of the two preceding embodiments, save for the difference that in this embodiment, the wiper of the container 205 has no flange and that therefore the element 208*c* of the application element has an annular gasket 222 in its zone which comes to be applied against the neck of the reservoir 205, which gasket ensures the seal between the element 208*c* on the one hand, and the neck of the reservoir 205 on the other hand, the compression of the gasket 222 being obtained in the same way as in the case of the second embodiment. For this purpose, the application element is completely depressed into the reservoir 205, to cause the gasket 222 to bear on the neck of the reservoir 205, whereupon the gripping means 207 is caused to pivot to bring it between the tabs 213*g*, 213*h* and, when the gripping means is blocked in this retaining means, the studs 212*a*, 212*b* of the gripping means come to bear against the arms of the T of the stop 211 so as to compress the gasket 222.

A mirror 202 has been placed on the face 201*a* of the shell 201 which allows the user to obtain a more accurate make-up by means of the applicator component (not shown) which is disposed at the free end of the stem 208*a* of the application element of the applicator.

It will be seen that in this embodiment, it is possible to accommodate a reserve container in the packaging unit in accordance with the invention without in any way increasing the bulk of the first embodiment described. In addition, gripping means 207 may be telescopic and thus be extendable to a second portion as indicated by gripping means 207', as shown in FIG. 10.

Figure 11:
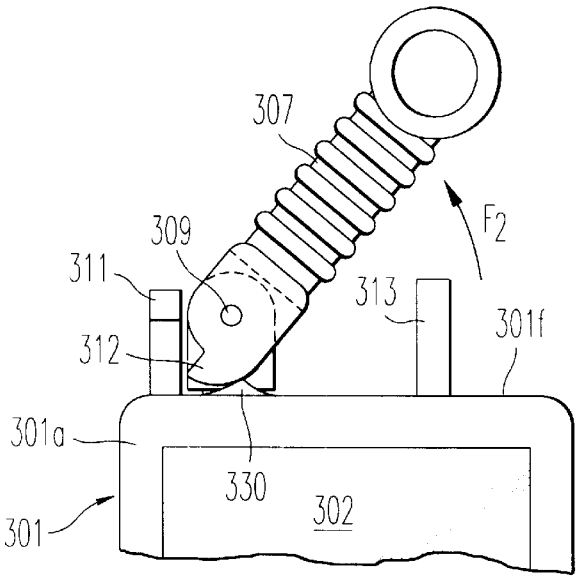
FIG. 11 shows in elevation a detail of a fourth embodiment of the packaging unit in accordance with the invention, wherein the case carries a projection allowing the applicator to be lifted in the course of pivoting of the gripping means.
Figure 12:
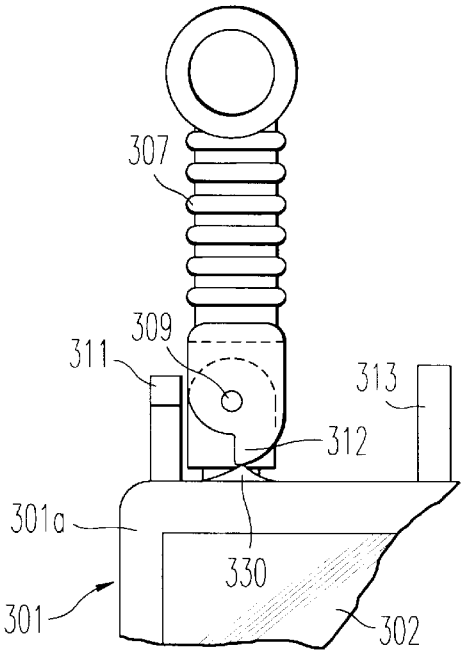
FIG. 12 shows the packaging unit of FIG. 11 when the gripping means has completely pivoted so as to become aligned with the axis of its associated reservoir.

FIGS. 11 and 12 represent a fourth embodiment of the packaging unit in accordance with the invention, wherein the reference numerals adopted for the first embodiment have been used again for the corresponding elements of this new embodiment, but which appear in a 300 series.

The shell 301 of this packaging unit carries a mirror 302 on its side 301*a*. On its small side 301*f*, the shell carries a clip 313 identical with the clip 113, this elastic clip 313 constituting the means for retaining a gripping means 307 identical with the gripping means described for the preceding embodiments. Two studs 312 are disposed at the first end of the gripping means 307 beyond the pivot pin 309. These studs 312 cooperate with a T-shaped stop 311 identical with the stops of the preceding embodiments. The shape of the studs 312 is defined, on the one hand, by a half flat which comes to bear against the arms of the T of the stop 311, and on the other hand, by a rounded portion which, in the course of the pivoting of the gripping means 307 round the pin 309, comes in contact with a profiled projection 330 carried by the side 301*f* of the shell 301.

If, starting from a position wherein the gripping means 307 bears against the side 301*f* of the shell (which corresponds to the leakproof obturation of the reservoir), the gripping means 307 is acted on along arrow F2, in this case, the rounded edges of the studs 312 come to bear against the profiled projections 330 which generate a force perpendicular to the side 301*f* in the direction which corresponds to the opening of the reservoir of the packaging unit. The result is detachment of the gasket which is provided, as in the preceding embodiments, between the application element and the neck of the reservoir, which makes it possible to ensure that the product contained in the reservoir is used without difficulty even though there is a slight sticking at the level of the seal.

Figure 13:
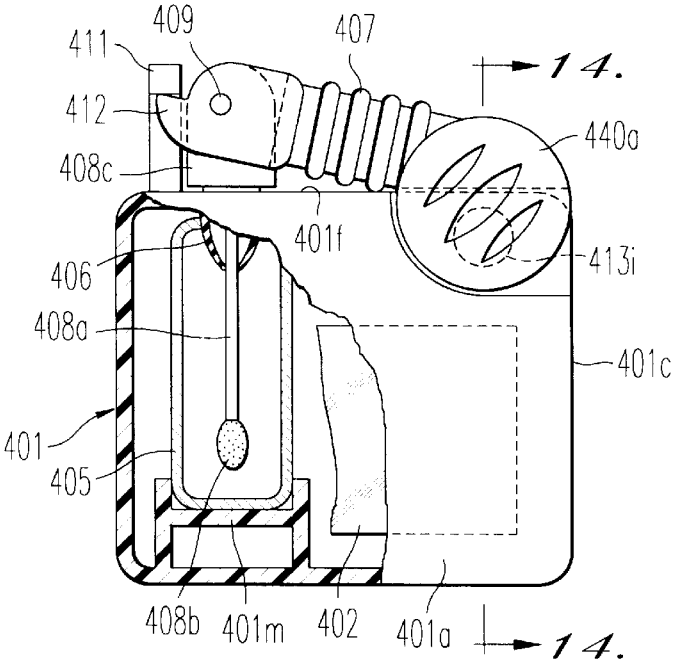
FIG. 13 shows an elevational, partly sectioned, representation of a fifth embodiment of the packaging unit in accordance with the invention.
Figure 14:
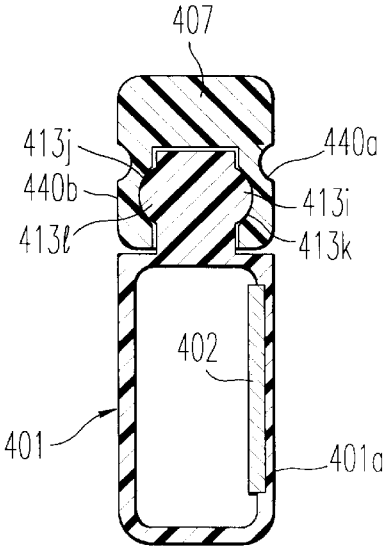
FIG. 14 shows a section taken along line 14—14 of FIG. 13.

A fifth embodiment has been represented in FIGS. 13 and 14, for which the various elements have been designated by the reference numerals which, in the case of the elements corresponding to those of the first embodiment are those of this first embodiment, appear now in the 400 series.

The shell 401 is formed by two half-shells which are symmetrical with reference to a plane, and which are welded to each other so as to constitute the shell. As in the third embodiment, these half-shells are symmetrical with reference to a plane and they each have a seating block 401*m* whereon there is placed in position the bottom of a reservoir 405 which is provided with a wiper 406. This packaging unit has a single reservoir, and therefore a single applicator, whose application element is constituted by an element 408*c* carrying a stem 408*a* at the free end of which there is disposed an applicator component 408*b* here constituted by a flocked ovoid surface. The application element is articulated for pivoting round a pin 409, with a gripping means 407, the pivot pin 409 being carried by the element 408*c*. As in the preceding cases, the leakproof obturation of the reservoir 405 is obtained by bringing the gripping means 407 to bear against the side 401*f* of the shell 401, the studs 412 then coming to bear against the arms of the T constituted by the stop 411. In this embodiment, the retaining means which keeps the studs 412 bearing against the stop 411 is constituted by a catch engagement means. The second end of the gripping means 407, that is to say the end which is further from the pivot pin 409 is constituted by two cheek plates 440*a*, 440*b* which come to bear on either side of the shell 401 in the vicinity of the corner formed by the small sides 401*f* and 401*c*. On their sides facing each other, these two cheek plates have hemispherical cutouts 413*i*, 413*j* respectively which, when the cheek plates come on either side of the corresponding zone of the shell 401, cooperate with hemispherical bosses 413*k*, 413*l* respectively carried by the shell 401. Thus a catch engagement is obtained constituting a retaining means sufficient for maintaining a leakproof obturation of the reservoir 405 by the bearing of the element 408*a* on the neck of the reservoir, with the interposition of a gasket.

The half-shell which corresponds to the side 401*a* of the shell internally carries a mirror 402, the half-shell being constituted opposite the mirror 402 by a transparent plastic material. The mirror 402 is thus protected from the outside, while rendering the same services as the mirror 2 of the first embodiment.

The embodiments of FIGS. 7 to 14 have, moreover, the advantages which have been specifically indicated, the same advantages as those indicated for the embodiment of FIGS. 1 to 6.

Figure 15:
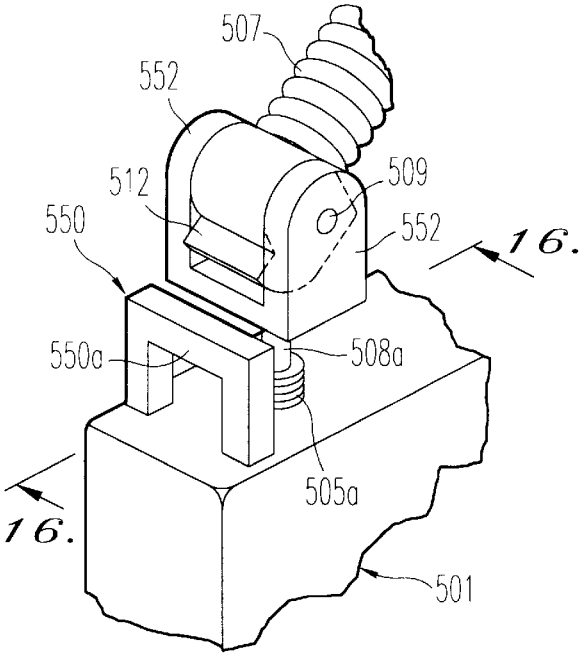
FIG. 15 shows, in perspective, a detail of a packaging unit wherein the stop has the shape of a shackle.
Figure 16:
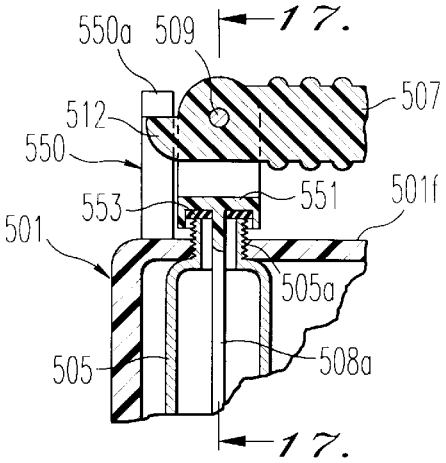
FIG. 16 shows a section taken along line 16—16 of FIG. 15, the applicator being in its position of obturating the reservoir.
Figure 17:
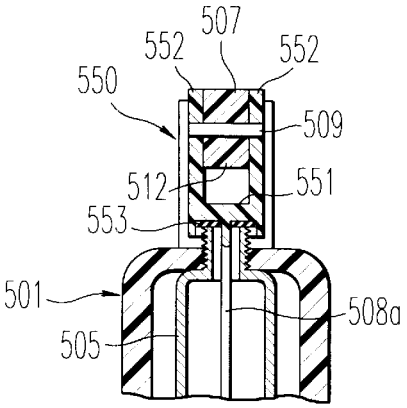
FIG. 17 shows a section taken along line 17—17 of FIG. 16.

A sixth embodiment has been represented in FIGS. 15 to 17, in respect of which the various elements have been designated by reference numerals which for the elements corresponding to those of the first embodiment, are those of the first embodiment, now appear in the 500 series.

The shell 501 has a parallelepiped shape and contains a single reservoir 505 whose threaded neck 505*a* is screwed into an opening of a small side face 501*f* of the shell 501. A projecting shackle 550 is arranged on the small side face 501*f* which has two lateral arms connected to one another by a web 550*a*.

This packaging unit has an applicator associated with the reservoir 505. This applicator is constituted by an application element formed by a stem 508*a* at the free of which there is disposed an applicator component, not shown in the drawings. The stem 508*a* is integral with a small plate 551 which carries two sides 552 which are parallel to one another and parallel to the stem 508*a*. A gripping means 507 is capable of rotating between the side 552 round a pin 509; the pin 509 is carried by the sides 552. At its end near the pin 509, the gripping means 507 has a stud 512. As in the preceding cases, the leakproof obturation of the reservoir 505 is obtained by bringing the gripping means 507 to bear against the side 501*f* of the shell 501, the stud 512 then coming to bear against the web 550*a* of the shackle 550, the web constituting the stop associated with the gripping means. On the side of the small plate 551 which is opposite the neck 505*a*, there has been provided a cylindrical groove wherein the end of the said neck comes to be accommodated, a gasket 553 being disposed at the bottom of said cylindrical groove. The gripping means 507 cooperates with a retaining means (not shown) carried by the side 501*f*.

The advantages of this embodiment are the same as those mentioned above for the embodiment of FIGS. 1 to 6.

Figure 18:
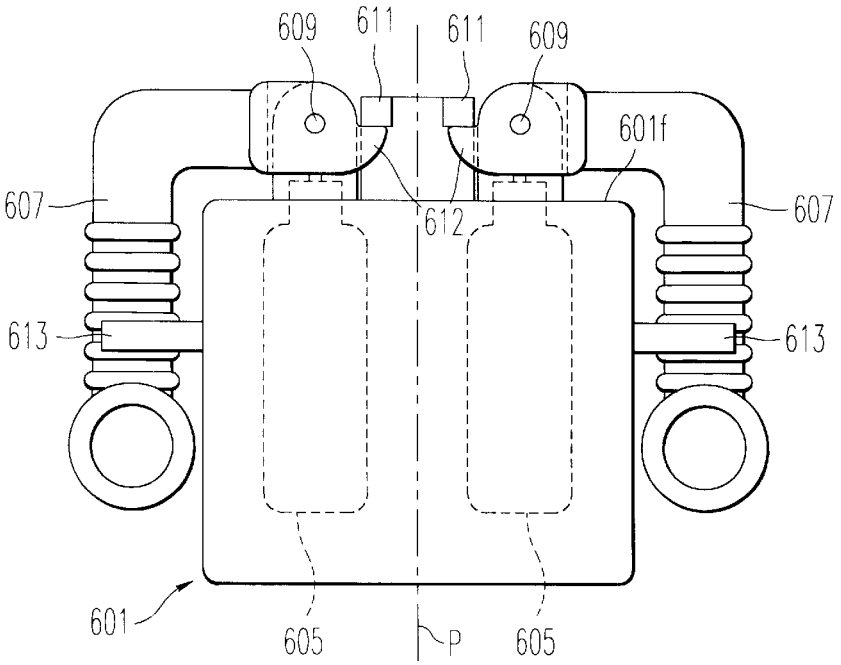
FIG. 18 shows in elevation a packaging unit in accordance with the invention, comprising two reservoirs which are parallel and aligned in the same direction.

FIG. 18 represents a seventh embodiment, in respect of which the various elements have been designated by reference numerals which, for the elements corresponding to those of the first embodiment, are those of this first mode increased by 600.

The shell 601 is a parallelepiped shell which contains two reservoirs 605 symmetrically disposed with reference to a plane P perpendicular to the two large rectangular sides of the shell 601. The plane P is one of the planes of symmetry of the shell 601 and constitutes a median plane for the two reservoirs 605. Each of the two reservoirs 605 is constituted exactly like the reservoir 5 of the first embodiment described above.

One applicator is associated with each of the reservoirs 605. Each applicator comprises an application element (not shown), identical with that of the first embodiment, and a gripping means 607 which is articulated relative to the application element round a pin 609. As in the first embodiment, each gripping means 607 has at its end near the pin 609, two studs 612, the two pairs of studs 612 facing each other above the small side face 601*f* of the shell 601. Each pair of studs 612 cooperates with a T-shaped stop 611, it being possible for the stems of the two Ts to be connected to one another, and the arms of the two Ts constituting the stops associated with each of the two gripping means 607.

Each gripping means 607 is formed with a right angle bend so that, when their associated application element is placed in position in the corresponding reservoir 605, it is possible to cause the gripping means 607 to pivot to bring it to bear against the shell 601. Because of its right-angled shape, the gripping means then traces the outline of the corner formed by the side 601*f* and by one or the other of the two small side faces which are adjacent thereto. The end of each of the gripping means 607 which is on the opposite side to that where the studs 612 are located, cooperates with a retaining means 613 identical with the retaining means 113 described for the second embodiment. It would, moreover, be possible to use a different retaining means, for example, a catch engagement means having a stud integral with a small side face of the shell 601 and a cutout cut in the gripping means 607, to permit the catch engagement of the stud.

Figure 19:
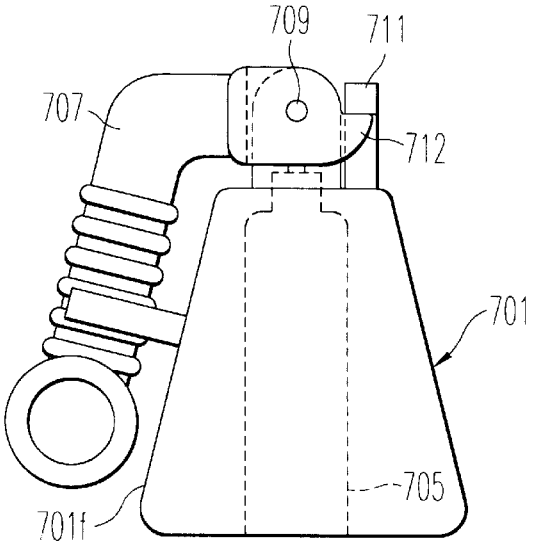
FIG. 19 shows in elevation a packaging unit in accordance with the invention, whose shell has two large parallel triangular sides, it being possible for the gripping means to come to bear against a small side of the shell.

An eighth embodiment of the packaging unit in accordance with the invention has been schematically represented in FIG. 19. The various elements of this embodiment have been designated by reference numerals which, for the elements corresponding to those of the first embodiment are those of this first embodiment but which now appear in the 700 series.

In this embodiment, the shell 701 has the shape of an upright prism whose large sides are triangular. The packaging unit contains a single reservoir 705 which can be completely identical with the reservoir 5 of the first embodiment. The applicator which is associated with this reservoir 705 has an application element identical with that of the first embodiment, but the gripping means 707 has in the vicinity of its pivot pin 709 a pair of studs 712 which are angularly offset relative to the longitudinal element constituted by the gripping means 707. These studs 712 cooperate with a T-shaped stop 711. When the gripping means 707 comes to bear against one of the small side faces 701*f* of the shell 701, the studs 712 cooperate with the sides of the T constituted by the stop 711 to ensure the obturation of the reservoir 705, as in the first embodiment.

Figure 20:
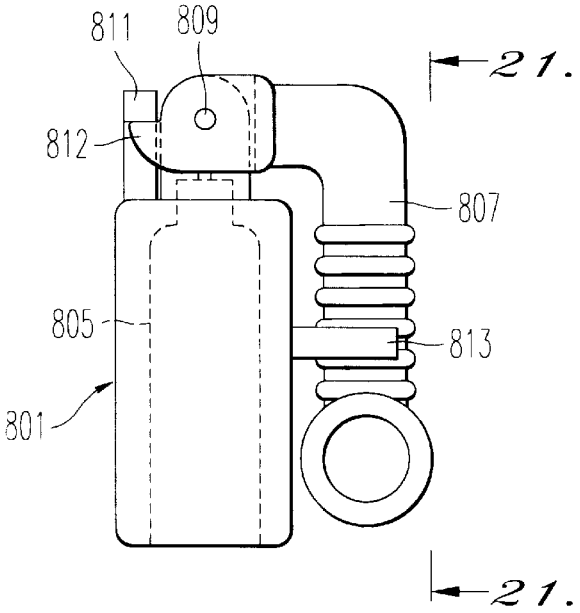
FIG. 20 shows in elevation a packaging unit in accordance with the invention whose shell has the same shape as in the embodiment of FIG. 19, but whose gripping means can come to bear against a large triangular side of the shell.
Figure 21:
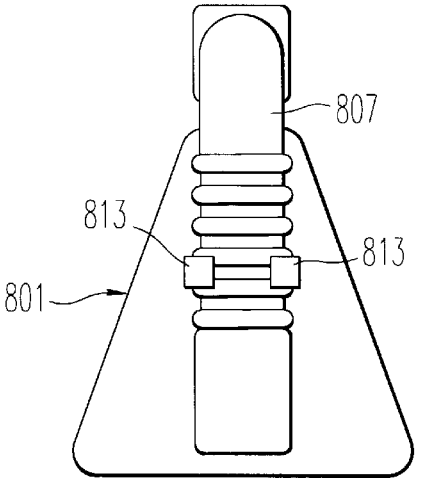
FIG. 21 shows a view taken along line 21—21 of FIG. 20.

A variant of the embodiment of FIG. 19 has been represented in FIGS. 20 and 21; in this ninth embodiment, the various elements have been designated by reference numerals which, for the elements corresponding to those of the first embodiment, are those of this first embodiment but which are now in the 800 series.

It will be seen that the shell 801 is entirely similar to the shell 701; this packaging unit has a single reservoir 805 and a single applicator. The difference, as regards the preceding embodiment, is due to the fact that the gripping means 807 has a right-angled shape; it pivots relative to its associated application element round the pin 809 and it carries in the vicinity of the pin 809 a pair of studs 812 which cooperate with a T-shaped stop 811. In this embodiment, when the reservoir 805 is obturated, the pivot pin 809 is parallel with the two large sides of the shell 801, instead of being perpendicular, and thanks to its right-angled shape the gripping means 807 can come to bear against one of the large triangular sides of the shell 801; in this position the gripping means 807 is held in position by a retaining means 813 which may be, for example, of the type of retaining means 113 described for the second embodiment.

Figure 22:
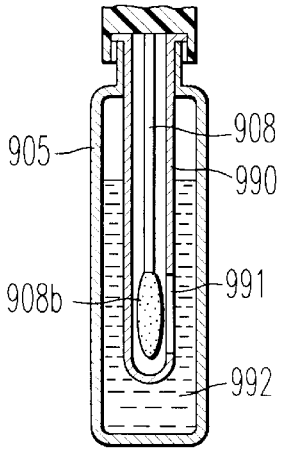
FIG. 22 schematically shows a reservoir provided with a glove finger with a capillary slot.

Finally, a variant of the embodiment of a reservoir has been schematically represented in FIG. 22. This reservoir 905 does not contain a wiper of the type which has been described for the first embodiment for example, but contains instead a glove finger 990 in which the application element 908 is placed in position. This glove finger has one or more capillary slots 991 which allow the product 992 to pass in the direction towards the applicator component 908*b* of the application element 908 but, because of the capillary size of the slot 991, the passing of the product 992 is effected in a controlled manner, which leads to a result similar to that obtained by the wiper 6 described in the first embodiment.

What is claimed as new and desired to be secured by Letters Patent of the United States is:

1. A packaging unit permitting the storage and the application of a liquid or pasty product to a base, said packaging unit comprising:

at least one reservoir containing a product to be applied and having a neck member;

an applicator engageable with said neck member of said at least one reservoir, said applicator comprising an applicator element and a gripping member interconnected with said applicator element by a pivot pin, the applicator element being accommodatable in said at least one reservoir into which the applicator element is penetrable through an opening in said neck of said at least one reservoir and being detachable from said at least one reservoir, a sealing member provided between said at least one reservoir and said applicator element, said sealing member allowing obturation of said at least one reservoir by said applicator element, said obturation being obtained by an appropriate positioning of the gripping member relative to said at least one reservoir; and a shell within which said at least one reservoir is contained, said shell providing free access to the opening of said at least one reservoir, the obturation of said at least one reservoir being obtained when the applicator element is accommodated in said at least one reservoir by compressing the sealing member of said at least one reservoir by positioning of the gripping member of said applicator element along the shell, at least one of said shell and said gripping member including a compression member to ensure compression of the sealing member.

2. A packaging unit according to claim 1, wherein the product to be applied comprises one of a cosmetic product, a hair product, and a make-up product, and wherein the base for application comprises one of the skin, keratinous fibers, and nails of the user.

3. A packaging unit as claimed in claim 1, wherein said applicator element and gripping element are interconnected at a position located outside the reservoir when the applicator element is accommodated within the reservoir.

4. A packaging unit according to claim 1, wherein said at least one reservoir comprises a single reservoir and said applicator comprises a single applicator.

5. A packaging unit according to claim 1, wherein said at least one reservoir comprises two reservoirs, each of said reservoirs being connected with one said applicator.

6. A packaging unit according to claim 5, wherein said two reservoirs are disposed in a head-to-tail manner inside the shell.

7. A packaging unit according to claim 6, wherein, upon the reservoirs are obturated by the applicator associated therewith, the gripping member of the applicators is disposed in a head-to-tail manner on two opposite sides of the shell.

8. A packaging unit according to claim 5, wherein the two reservoirs are disposed parallel to one another and are aligned in the same direction inside the shell on either side of a median plane.

9. A packaging unit according to claim 8, wherein, upon the two reservoirs being obturated by the applicator associated therewith, the gripping member of each of the said applicators are disposed symmetrically relative to a median plane disposed between the two reservoirs.

10. A packaging unit according to claim 1, wherein the shell comprises two half-shells connected to one another.

11. A packaging unit according to claim 10, wherein the two half-shells are interconnected by a film hinge or are joined by a catch engagement.

12. A packaging unit according to claim 11, wherein inside the shell there is disposed at least one reserve container interchangeable with said at least one reservoir.

13. A packaging unit according to claim 12, wherein said at least one reservoir comprises two reservoirs wherein inside the shell, the axis of one of said two reservoirs is parallel with the axis of one of a second reservoir of said two reservoirs and with the axis of the reserve container.

14. A packaging unit according to claim 1, wherein the shell defines a space in the form of a rectangular parallelepiped and comprises two large parallel sides, said gripping member bearing against a small side of the parallelepiped shell when the at least one reservoir is obturated, and a longitudinal axis of the at least one reservoir being perpendicular to one of the small sides of said shell against which said gripping member bears.

15. A packaging unit according to claim 14, wherein a large side portion of the shell has a mirror positioned thereon.

16. A packaging unit according to claim 1, wherein the shell defines a space in the form of an upright prism comprising two large parallel, substantially triangular sides, said gripping member bearing against one of the sides of the shell when the at least one reservoir is obturated.

17. A packaging unit according to claim 1, wherein said at least one reservoir includes a wiper wiping the applicator element.

18. A packaging unit according to claim 1, wherein said at least one reservoir includes a glove finger having at least one capillary opening, said at least one opening dosing the product onto the applicator element.

19. A packaging unit according to claim 1 wherein, when the applicator is in a position obturating the reservoir, the pivot pin is perpendicular to the large sides of the shell.

20. A packaging unit according to claims 1, wherein the shell is perforated.

21. A package unit according to claim 1 wherein the compression member comprises a stop located on said shell and the zone of the first end of the gripping member bears against said stop when said gripping member is brought to bear against the shell so as to exert a force on the applicator in a direction towards the at least one reservoir.

22. A packaging unit according to claim 21, wherein the stop is T-shaped and wherein in the zone of the first end of the gripping member there are two studs, each of said studs bearing against a respective arm of the T-shaped stop.

23. A packaging unit according to claim 21, wherein the stop comprises a shackle and wherein the zone of the first end of the gripping member has a stud which bears against the web of said shackle.

24. A packaging unit according to claim 1, wherein the gripping member is pivotable about said pin, and wherein at least one of said applicator element and the gripping member includes a restraining member preventing free pivoting of the gripping member relative to the applicator element.

25. A packaging unit according to claim 1, wherein the shell includes at least one projection cooperating with a zone of a first end of a gripping member when the gripping member pivots to eliminate the obturation of the at least one reservoir, so as to lift the applicator element from the at least one reservoir.

26. A packaging unit according to claim 1, wherein the at least one retaining member comprises an elastic clip projecting from the side of the shell along with the gripping member bears in the obturating of the at least one reservoir.

27. A packaging unit according to claim 1, wherein the retaining member comprises a catch engagement member located in proximity with the side of the shell along which the gripping member bears directly between said shell and said gripping member in the course of the obturating of the reservoir.

28. A packaging unit according to claim 1, wherein the at least one reservoir is disposed in a recess of the shell, so as to be extractable via a small side of the shell along which the gripping member of the applicator comes to bear, or via an opposite small side portion of the shell.

29. A packaging unit according to claim 1, wherein the applicator has a telescopic gripping member.

30. A packaging unit according to claim 1, wherein the applicator element includes a stem having an end at which is disposed an applicator component.

31. A packaging unit according to claim 30, wherein the applicator component has a rough surface obtained by being molded together with one of the stem, a brush, a pencil brush, an elastomeric quill, a flocked surface, and a felt member.

* * * * *